United States Patent [19]

Swanson

[11] 4,160,721

[45] Jul. 10, 1979

[54] DE-SULFURIZATION OF PETROLEUM RESIDUES USING MELT OF ALKALI METAL SULFIDE HYDRATES OR HYDROXIDE HYDRATES

[76] Inventor: Rollan Swanson, 220 California Ave., Santa Monica, Calif. 90403

[21] Appl. No.: 898,206

[22] Filed: Apr. 20, 1978

[51] Int. Cl.[2] ..... C10G 34/00; C10G 29/10; C10G 19/00

[52] U.S. Cl. ..... 208/230

[58] Field of Search ..... 208/230, 226, 229, 209, 208/212

[56] References Cited

U.S. PATENT DOCUMENTS

| | | | |
|---|---|---|---|
| 1,300,816 | 4/1919 | Cobb | 208/229 |
| 1,805,444 | 5/1931 | Wilson | 208/230 |
| 1,838,031 | 12/1931 | Stratford et al. | 208/229 |
| 2,028,335 | 1/1936 | Kalichevsky | 208/230 |
| 2,954,340 | 9/1960 | Hunter | 208/230 |
| 3,382,168 | 5/1968 | Wood et al. | 208/212 |
| 3,483,119 | 12/1969 | Ehrler | 208/212 |

*Primary Examiner*—George Crasanakis
*Attorney, Agent, or Firm*—Albert F. Kronman

[57] ABSTRACT

Petroleum residues are reduced in sulfur content by intimately contacting one volume of petroleum residue with at least 0.25 volume of alkali metal sulfide hydrate melt, or alkali metal hydroxide hydrate melt or mixtures thereof, within a closed system, at a temperature between 120° C. and 325° C., for from 3 to 60 minutes, thereafter separating de-sulfured petroleum residue from said alkali metal sulfide hydrate melt by a hot liquid-liquid separation, thereafter utilizing said separated alkali metal sulfide hydrate melt to de-sulfur additional petroleum residue.

11 Claims, No Drawings

DE-SULFURIZATION OF PETROLEUM RESIDUES USING MELT OF ALKALI METAL SULFIDE HYDRATES OR HYDROXIDE HYDRATES

BACKGROUND OF THE INVENTION

Conventional de-sulfurization of petroleum residues by high temperature and high pressure catalytic methods using hydrogen to remove sulfur become less economically attractive when high sulfur content petroleum residues are to be reduced to 0.25% or less sulfur content.

The primary objective of the process of this invention is to de-sulfur petroleum residues by a non-catalytic method which uses lower temperatures and lower pressures and shorter residence times than do the present conventional de-sulfuring processes.

The secondary objective of the process of this invention is to utilize non-volatile, recoverable and recyclable reagents to de-sulfur petroleum residues thereby reducing the thermal, chemical, air and water pollution normally associated with the de-sulfuring of petroleum residues.

A further objective of the process of this invention is to accomplish the other objectives at lower cost than the conventional methods with equivalent sulfur reduction.

SUMMARY OF THE INVENTION

The objectives of the process of this invention are accomplished by utilizing little hydrolyzed forms of alkali metal sulfide hydrate melts to react with the organic and elemental sulfur present in petroleum residues thereby forming alkali metal polysulfide, thereby removing said sulfur forms from said petroleum residues. After the removal of organic and elemental sulfur from petroleum residues, the de-sulfured petroleum residue is immiscible with non-hydrolyzed alkali metal sulfide hydrate. A liquid-liquid separation readily separates de-sulfured petroleum residue from the surface of the alkali metal sulfide hydrate melt.

The process-temperatures are between 200° C. and 260° C.

The process-pressures are below the critical pressure of water vapor at the selected process temperature. This critical pressure condition is corrected for the aqueous tension of the alkali metal sulfide hydrate melt.

The residence time of the petroleum residue in the alkali metal sulfide hydrate melt is from 3 minutes to 60 minutes, depending upon the desired degree of de-sulfurization.

The sulfur removed from the petroleum residue, during the process, forms alkali metal polysulfide by reaction with the alkali metal sulfide hydrate melt. This alkali metal polysulfide is only slightly soluble in the alkali metal sulfide hydrate melt. The alkali metal polysulfide is heavier than the alkali metal sulfide hydrate melt and sinks to the bottom of said melt. Liquid-liquid or liquid-solid separations remove alkali metal polysulfide from the process-system.

Disclosure

Disclosed is the process of an invention for reducing the sulfur content of petroleum residues, by intimately contacting one volume of said petroleum residues with at least 0.25 volume of a liquid reagent selected from a series comprised of little hydrolyzed forms of alkali metal sulfide hydrates or alkali metal hydroxide hydrates or mixtures thereof, for from 3 minutes to 60 minutes, at a process-temperature selected in the range between 120° C. and 325° C., thereafter separating de-sulfured liquid petroleum residues from said liquid reagent by liquid-liquid separations, thereafter utilizing said separated liquid reagent to de-sulfur additional petroleum residues.

For the purposes of this disclosure, the term "petroleum residues" shall include all petroleum fractions having boiling points above the particular process-temperature selected from the 120° C. to 325° C. range.

A more rapid reduction of the sulfur content of petroleum residues is achieved when the alkali metal sulfide hydrate reagent has a minimum sulfur content equivalent to $Cs_2S_{1.1}$, $Rb_2S_{1.1}$, $K_2S_{1.1}$, $Na_2S_{1.1}$, or $Li_2S_{1.1}$. The alkali metal sulfide hydrate reagent may be used to de-sulfur petroleum residues until the empirical sulfur content reaches that of $Cs_2S_3$, $Rb_2S_3$, $K_2S_3$, $Na_2S_2$ or $Li_2S_2$. Alkali metal sulfide hydrates alone or used as the reagents of the process of this invention in conjunction with alkali metal hydroxide hydrates will begin to reduce the sulfur content of petroleum residues at temperatures as low as 120° C., whereas alkali metal hydroxide hydrates do not begin to reduce the sulfur content of petroleum residues at temperatures below 185°-190° C. A greater reduction of the sulfur content of petroleum residues is achieved with alkali metal sulfide hydrates or alkali metal sulfide hydrates mixed with alkali metal hydroxide hydrates, at any temperature between 200° C. and 325° C., than is achieved by use of the same alkali metal hydroxide hydrate alone.

The alkali metal sulfide hydrates and the alkali metal hydroxide hydrates and mixtures thereof of cesium, rubidium or potassium have a greater ability to remove and retain sulfur removed from petroleum residues, thru the formation of more stable polysulfides, than do the alkali metal sulfide hydrates and the alkali metal hydroxide hydrates and mixtures thereof of sodium or lithium. Potassium sulfide hydrate and potassium hydroxide hydrate are the preferred reagents of the process of this invention.

Technical grade potassium hydroxide flakes are a solid form of potassium hydroxide hydrate. Technical grade potassium hydroxide flakes are available commercially. These flakes of potassium hydroxide melt below 185° C. Potassium hydroxide hydrate melts will begin to reduce the sulfur content of high temperature vacuum produced petroleum residues at 185° C. to 200° C. The degree of sulfur reduction that can be achieved at a given temperature in the range between 185° C. to 275° C., is reached in from 15 to 20 minutes. A longer residence time, at temperatures below 275° C., does not change the degree of de-sulfurization achieved. Above 275° C., additional de-sulfuring of petroleum residues is achieved in from 15 to 20 minutes but a longer residence time slowly begins to increase the sulfur content of the petroleum residue to levels above that achieved in the 15 to 20 minute de-sulfuring time. This re-sulfidization of petroleum residue is observed when potassium hydroxide hydrate is used as the process-reagent at temperatures above 275° C. and this re-sulfidization is more pronounced with progressively higher temperatures and longer residence times.

Sodium hydroxide hydrate is heated in a closed system with sufficient water condensed at the critical pressure of water vapor at the selected process-temperature to make a saturated sodium hydroxide hydrate solution.

This saturated aqueous solution of sodium hydroxide hydrate will begin to reduce the sulfur content of high temperature vacuum produced petroleum residues at temperatures above 200° C. Peak de-sulfuring is achieved in from 15 to 20 minutes. As with the use of potassium hydroxide hydrate reagent, progressively greater de-sulfurization of petroleum residues is achieved as the temperature is progressively elevated but above 265° C. a degree of re-sulfurization of the petroleum residue occurs when longer residence times than those required for peak de-sulfurization are used.

High temperature vacuum produced petroleum residues, de-sulfured with melts of alkali metal hydroxide hydrates, show an initial sulfur reduction of from 27 to 36% in a 15 to 20 minute residence time, at temperatures below 220° C. At higher temperatures a much slower rate of additional sulfur reduction is observed. At 265° C., a reduction of 30–40% of the sulfur content of petroleum residue is observed in a 15–20 minute residence time. At 325° C. a reduction of from 32–44% of the sulfur content of these petroleum residues is observed in a 15–20 minute residence time.

At temperatures above 275° C., a reduction of the hydrogen content of the petroleum residue is observed when either alkali metal sulfide hydrates or alkali metal hydroxide hydrates are used as the reagents to reduce the sulfur content of petroleum residue. This reduction of the hydrogen content of petroleum residue increases as the temperature is increased above 275° C.

The alkali metal sulfide hydrates reduce the sulfur content of petroleum residues at lower temperatures than do the alkali metal hydroxide hydrates, when substantial portions of the alkali metal sulfide hydrate remains in a non-hydrolyzed state. The alkali metal sulfide hydrates reduce the sulfur content of petroleum residues to a substantially greater degree at each temperature of the process-temperature range than do the alkali metal hydroxide hydrates. A sulfur reduction of over 90% can be achieved at temperatures of 325° C. when the petroleum residue is removed from contact with the alkali metal sulfide hydrate at the peak de-sulfuring time before re-sulfidization of the petroleum residue occurs.

Both the alkali metal sulfide hydrate melts and the alkali metal hydroxide hydrate melts solidify at the higher process-temperatures or at prolonged use at lower temperatures. An air evacuated process-system with a water vapor atmosphere will maintain these melts in liquid state within a closed process-system.

It is desirable to provide the process-system with a means of injecting steam at process-temperatures to maintain the liquid state of the hydrated melts. It is also desirable to fit the process-system with a means of reducing the water content of the process-system. The volatiles can be exited from the process-system thru a pressure valve which opens at a selected pressure below the critical pressure of water at the process-temperature. The volatiles which exit the process-system are then compressed to above the critical pressure of water while the process-temperature is maintained by cooling the volatiles during this compression. Condensed liquid water is removed from the process-system and the volatiles are returned to the process-system.

It is also desirable that hydrogen under a partial pressure of from 2 to 5 atmospheres constitute a part of the atmosphere of the process-system. The presence of this hydrogen will assist in the de-sulfuring of petroleum residue and will prevent the formation of petroleum fractions of higher molecular weights than the original petroleum residue.

Following the residence time required for the de-sulfuring of petroleum residues, the de-sulfured petroleum residue will readily separate from unagitated alkali metal sulfide hydrate or alkali metal hydroxide hydrate when little water is present in excess of that of the hydrated melts. A liquid-liquid separation is made.

The separated hot petroleum residue is treated with steam, at the same temperature as the petroleum residue, to remove any alkali metal sulfide hydrate or alkali metal hydroxide hydrate particles from the de-sulfured petroleum residue. A further liquid-liquid separation is made to remove this water solution of alkali metal sulfide hydrate or alkali metal hydroxide hydrate from the de-sulfured petroleum residue.

The separated alkali metal sulfide hydrate or alkali metal hydroxide hydrate is then used to de-sulfur additional petroleum residue.

A mixed melt of alkali metal sulfide hydrate and alkali metal hydroxide hydrate should contain at least 40% alkali metal sulfide hydrate for most efficient de-sulfuring of petroleum residues.

EXAMPLE 1

Equal volumes of reagent, containing approximately 50% potassium sulfide hydrate and 50% potassium hydroxide hydrate, and a petroleum residue containing 2.9% sulfur here heated to 205° C. and maintained at that temperature in an open iron crucible under a stream of nitrogen, for 20 minutes. Thereafter, the crucible and its contents were removed from the heat source and cooled until the reagents solidified. The petroleum residue was poured off leaving the solidified reagent in the crucible. The sulfur content of the petroleum residue had been reduced to 1.85% and the petroleum residue now contained 1.0% ash. The petroleum residue was then heated to 110° C. and steam was passed thru the petroleum residue. A liquid-liquid separation was made thereby separating the petroleum residue from the water solution of the alkali metal sulfide hydrate and the alkali metal hydroxide hydrate. An analysis of the remaining sulfur content of the separated petroleum residue showed a 1.7% sulfur content. The ash content had been eliminated.

EXAMPLE 2

100 cc of a high temperature vacuum produced petroleum residue containing 1.22% sulfur was mixed with 80 cc of solid potassium sulfide hydrate and 1.5 cc of water and placed in a container which was then sealed. The solid potassium sulfide hydrate had been prepared from a melt of potassium sulfide pentahydrate at 185° C. under a reduced pressure of 26 mm Hg. When the solid hydrate was formed, it was placed in the reaction container as stated above. Hydrogen was added to the sealed container and the cold pressure of the container was 2 atmospheres.

The container and its contents were rapidly brought to 325° C. and maintained at that temperature for 12 minutes. Thereafter, the contents of the container were exited thru a stopcock at the bottom of the container. The exited potassium sulfide hydrate solidified upon leaving the pressurized container. A liquid-solid separation was made to separate the petroleum residue from the solid reagent. When the separated petroleum residue had cooled to 145° C., steam, at 145° C., was passed thru the petroleum residue under pressure. A liquid-liquid separation separated the condensed water solution of reagent from de-sulfured petroleum residue. Analysis of the petroleum residue showed a 0.09% sulfur content.

EXAMPLE 3

200 cc of 3.8% sulfur content petroleum residue and 200 cc of potassium sulfide hydrate were placed in a sealed container, under a hydrogen atmosphere at a cold pressure of 2 atmospheres. The potassium sulfide hydrate had been prepared from potassium sulfide pentahydrate crystals which were melted and then solidified at 150° C. under 76 mm Hg evacuation pressure. The solid potassium sulfide was believe to be potassium sulfide dihydrate. Water, derived from the decomposition of potassium sulfide hydrate into lower hydrates, within the closed process-system, at process-temperatures, was used to liquefy and then maintain the liquid state of the hydrate. The container and its contents were rapidly heated to 265° C. and maintained at 265° C. for 15 minutes. Thereafter the contents of the container were removed. The little hydrolized liquid potassium sulfide hydrate made a good separation as a distinct layer below the petroleum residue. The layers were separated by liquid-liquid separations. The separated petroleum residue was treated with steam at 110° C. The petroleum residue was again separated by a liquid-liquid separation. The separated petroleum residue had a sulfur content of 0.129%.

EXAMPLE 4

100 cc of potassium hydroxide hydrate and 100 cc of 2.8% sulfur content petroleum residue were brought to 210° C. in a closed steel crucible and maintained at 210° C. for 40 minutes. The crucible was then cooled and the liquid petroleum residue poured off from the solidified potassium hydroxide hydrate. Steam was passed thru the petroleum residue. The petroleum residue had a residual sulfur content of 1.95%.

What is claimed is:

1. A process for reducing the elemental and organic sulfur content of petroleum residues, comprising contacting said residues with at least 0.25 volume thereof of a melt selected from the group consisting of alkali metal sulfide hydrates, alkali metal hydroxide hydrates or mixtures thereof at a process temperature range of between 120 degrees C. to 325 degrees C. for from about 3 to 60 minutes; separating said residues now having a reduced sulfur content from said melt; passing steam through said separated residues to separate said hydrates from said residues, and recovering said residues from separated water containing said hydrates.

2. The process of claim 1, wherein said contacting takes place under a hydrogen atmosphere.

3. The process of claim 1, wherein said reagent is a sulfide hydrate or hydroxide hydrate of cesium, rubidium, potassium, sodium or lithium.

4. The process of claim 1, wherein said petroleum residues have a boiling point above the process temperature range.

5. The process of claim 1, wherein said contacting ranges from about 3 to about 12 minutes.

6. The process of claim 1, wherein said process temperature is about 265° C.

7. The process of claim 1, wherein said contacting is effected under a hydrogen pressure of 2 to 5 atmospheres to reduce the formation of higher molecular weight fractions.

8. The process of claim 1 wherein solidified alkali metal polysulfide or alkali metal hydroxide hydrates are formed in said residues and are separated from said hydrates by precipitation.

9. The process of claim 1, wherein said melt is a mixed melt containing at least 40 percent thereof of an alkali metal sulfide hydrate.

10. The process of claim 1 wherein said reagent is recycled to said contacting step.

11. The process of claim 1, wherein said sulfide hydrates are defined by the formulas: $Cs_2S_{1.1}$; $Rb_2S_{1.1}$; $K_2S_{1.1}$; $Na_2S_{1.1}$; and $Li_2S_{1.1}$.

* * * * *